US005166677A

United States Patent [19]

Schoenberg

[11] Patent Number: 5,166,677

[45] Date of Patent: Nov. 24, 1992

[54] ELECTRIC AND ELECTRO-HYDRAULIC CONTROL SYSTEMS FOR SUBSEA AND REMOTE WELLHEADS AND PIPELINES

[76] Inventor: Robert G. Schoenberg, 27 Everglades St., Kenner, La. 70065

[21] Appl. No.: 535,190

[22] Filed: Jun. 8, 1990

[51] Int. Cl.[5] ..... G01V 1/00

[52] U.S. Cl. ..... 340/853.3; 166/335; 166/363; 166/65.1

[58] Field of Search ..... 340/853, 856, 857, 859, 340/853.3, 853.1; 166/335, 336, 363, 364, 65.1

[56] References Cited

U.S. PATENT DOCUMENTS 4,461,450 7/1984 Soland et al. ..... 251/63.5
4,757,314 7/1988 Aubin et al. ..... 340/856
4,796,708 1/1989 Lembcke ..... 166/386

*Primary Examiner*—J. Woodrow Eldred
*Attorney, Agent, or Firm*—Pravel, Gambrell, Hewitt, Kimball & Krieger

[57] ABSTRACT

An electro-hydraulic control system for subsea wellheads provides a water tight housing carrying therewithin an electric motor drive which operates a valve that is positioned adjacent but outside the water tight housing. A high ratio gear box within the water tight housing interfaces the motor drive and the valve while maintaining the flow control position of the valve such as open flow, closed flow, or incremental flow opening positions of the valving member. A dual tone multi-frequency controller activates the electric motor drive using a key pad at a remote location so that both operation of the valve and an indication of valve position can be achieved from the remote location.

18 Claims, 4 Drawing Sheets

DTMF CONTROL SYSTEM FLOW CHART FOR ELECTRO-HYDRAULIC OPERATION

DTMF CONTROL SYSTEM FLOW CHART FOR ELECTRIC OPERATION

ELECTRIC AND ELECTRO-HYDRAULIC CONTROL SYSTEMS FOR SUBSEA AND REMOTE WELLHEADS AND PIPELINES

BACKGROUND OF THE INVENTION

1. Field of The Invention

The present invention relates to control systems for remote onshore and offshore, subsea wellheads and more particularly relates to an improved electric or electro-hydraulic control system for wellheads especially subsea wellheads wherein an audible "touch tone" type operation allows remote opening and closing of the wellhead valving members as the tones are "interpreted" at the wellhead so that an electric motor is activated to operate a valve or blowout preventor. The system is also useful for operation of remote valves on a pipeline which are located in a remote location.

2. General Background

There are many offshore oil well wellheads which are remote and or under the water surface or in a subsea environment. These wellheads typically are equipment with numerous valves or blowout preventors for controlling fluid flow through the wellhead assembly which is typically in the form of a tree or Christmas tree or blowout preventor stack as is known in the art. The operation of these valves from a remote location would be desirable because of the time and expense connected with operating these subsea valves or blowout preventors manually using divers or by dispatching workers. Similarly, many pipelines have remote valves which would be desired to operate without divers or workers.

SUMMARY OF THE PRESENT INVENTION

The present invention provides an improved system for electric or electro-hydraulic control of wellheads and pipelines. The present invention is in the electro-hydraulic mode, and uses an electric motor to control hydraulic valves which thus control the tree valves or blow out preventors.

With the present invention used in the electro-hydraulic mode, ball valve controls can be used because they have low torque requirements compared to many of the shear seal type valves in general use. However, the present invention could also be used to control shear seal type valves.

The present invention features the use of a high ratio gear train reducer which reduces motor power requirements (amperage) and which also keeps the valve in position after power is turned off.

The present invention uses tone control, preferably dual tone multi-frequency controls. Thus, through the use of dual tone multi-frequency controlling, a common touch tone telephone could be used to control undersea wellheads.

The present invention uses an electric motor and high ratio gear train so that power requirements can be spread over the period of time which is necessary in order to fully turn these valves. Thus, the present invention requires less current and therefore, less power supply so that the size of umbilical cords and electrical wiring to the tree can be relatively small. A continuous current flow to the wellhead is not necessary with the system of the present invention.

Because a high gear ratio is used between the valve structure and the electric motor, no power is required to hold the valve in a particular desired position. With the present invention, an electric control system, preferably a dual tone multi-frequency instrumentation can be used for installing motors in direct communication with the wellhead tree valves and chokes, eliminating hydraulics all together.

The present invention provides an improved control system for subsea trees which allows manipulation of hydraulic ball valves which pressure up or vent off hydraulic fail safe actuators, thereby opening or closing the tree valves.

With the present invention, in order to close or open a function on the subsea tree, an operator on a production platform would simply push a button on a panel. While the switch is being pressed, an audible tone would be generated at the panel and also sent to the subsea tree via conductor wires. At the tree itself, the tone would be "interpreted" and an electric motor would turn a hydraulic ball valve through a high ratio gear train. The operator would hold the button pressed at a control panel until a light on the panel indicated that the hydraulic valve was in the correct valving position. An ammeter would also tell the operator when the motor had turned the valve to the proper position. Current consumption would rise to a given level, 500 ma. for example. When the valve reached the desired position, the motor would stop and current consumption would go down to a quiescent level, 200 ma. for example.

The present invention utilizes dual tone multi-frequency (DTMF) controls. At the control panel, DTMF signals are generated by single integrated circuit chip with a crystal control. The DTMF signals are decoded at the subsea tree using an integrated circuit chip. The chip sends hexadecimal codes to digital circuitry which controls the electric motor drive. The entire circuit can thus fit on a small circuit boards (for example 4 inches by 8 inches).

For operation on subsea wellheads, the electric motors and gear boxes are preferably mounted in a stainless steel housing which is pressure compensated to about 10 psi above ambient hydrostatic sea pressure. The housing is preferably filled with silicone based oil and connected to a spring loaded piston or bladder type pressure compensator. Output shafts from the gear boxes exit the housing from the bottom and a trash seal is used to keep seawater out of the housing. Should a seal leak, seawater would not enter the housing by virtue of the fact that the oil would "float" on top of the seawater and being incompressible would stop seawater intrusion.

A "readback" circuit is necessary so that the operator and the production platform knows the position of all functions on the subsea tree. The readback circuit will detect when a hydraulic ball valve has rotated to the desired position and light up a LED (light emitting diode). The readback circuit preferably consists of two circuit boards operating on the DTMF principal with a different frequency crystal than the control circuit. The readback circuit board at the subsea tree checks the position of each valve every time a valve is functioned and upon request from the platform.

The readback circuit at the wellhead sends bursts of DTMF tones back to the control panel. Each DTMF tone burst sent to the platform corresponds to a particular valve and its position at that moment. A "refresh switch" can be pushed on the panel at any time to recheck the valve positions, without shifting any valves. The bursts of DTMF tones from the tree are received at the control panel and decoded, an LED lights up and indicates the position of the ball valve. The LED remains lit until the valve is shifted to its opposite position. This system requires preferably a pair of twisted pairs of conductors from the platform to the subsea tree.

Hydraulic system pressure is from a 5,000 psi electric or air operated pump and reservoir skid on the platform. Pressure is transmitted through a three eighths ($\frac{3}{8}$) inch 5,000 psi hose from the platform to the tree. A tree mounted accumulator can store fluid at 5,000 psi and supply one ball valve which would control the SCSSV. A regulator would then reduce the pressure to 3,000 or 1,500 psi. This reduced pressure would then supply the rest of the ball valves and control the fail safe operators on the tree.

Up to eight four-way/two position ball valves can be mounted on the subsea tree. These ball valves are available commercially and have low operating torques. The hydraulic system would be of the closed type. System pressure would be shifted from one side of the actuator to the other as required, venting would be to an accumulator type receiver bottle. It is also possible to use an "open" type system where a water based hydraulic fluid is used to function a fail safe operator and then vent it to the sea when the valve is next functioned.

A fail safe feature of the system is the fact that loss of system pressure would cause all of the tree valves to automatically fail safe close. In the event that the umbilical was broken, production to the tree would shut in. Venting the system to tank at the platform would also close in the tree.

The present invention provides numerous advantages. It is superior to a straight hydraulic system in that umbilical costs are less. The present invention provides a system that has a faster response time than the straight hydraulic systems due to the fact that hydraulic power is stored at the tree in an accumulator and it is unnecessary to pressure up thousands of feet of hydraulic hose before pressure reaches the tree valve operator. Practical operating distance of a straight hydraulic system is about three miles. At that point, it takes about one and one half ($1\frac{1}{2}$) minutes to fail safe close a valve and about one (1) minute to open a valve. At the same distance the DTMF System would open and close the same valve in the order of twenty (20) seconds.

The dual tone multi-frequency system of the present invention uses CMOS and TTL low power integrated circuits. The design of the system is such that power is used only when the system is functioned by the operator to shift a valve or to refresh the read back circuit. This lends itself well to remote systems that could be mounted on unmanned platforms or at remote template locations. Practical operating distances for the DTMF system which is a portion of the present invention or a function of supply voltages. Thus operating distances vary with voltage as follows: 12 volt system - 2,000 ft., 24 volt system - 14,000 ft. or 2.5 miles, 36 volt system - 26,000 ft. or 5 miles, 48 volt system - 38,000 ft. or 7 miles.

To save umbilical costs for long distances it is possible with the present invention to delete the positive wire and use a solar power supply trickle charger mounted on a surface buoy to charge batteries or capacitors at the wellhead.

With the present invention, it is easy and cost effective to add extra wells. It is possible to control several wells without adding additional conductors to the control cable. Practically, it would be wise to control only two wells with four conductors, each well after that would require two extra conductors. Each well would require its own control panel and related electronics at the wellhead. No extra hydraulic would be required.

The use of the readback line can be expanded to transmit other information from the wellhead to the platform. Downhole temperature and pressure data could be sent back to the platform. This information is necessary for reservoir evaluation and in a straight hydraulic control system is available only through wireline operations. Monitoring casing annulus pressures could also be achieved by sending data on a readback line.

The proposed control system of the present invention has a simple hydraulic system with inexpensive ball valves at the tree.

This present invention provides an improved electrohydraulic control system for subsea wellheads which improves over existing systems available in the art. The apparatus includes a watertight housing having valves positioned adjacent to the housing for controlling fluid flow at a subsea wellhead with a movable valving member that moves into multiple flow control positions including at least a full open flow position and a closed flow position. An electric motor drive is provided and a high ratio gear box interfaces the motor drive and the valve for maintaining flow control position of the valve using the electric motor. A controller is provided for activating the electric motor drive and thus controlling valve position.

In the preferred embodiment, the housing is at least partially filled with oil.

The housing preferably comprises a pair of separate sections wherein one section contains the motor drive and the high ratio gear box.

In the preferred embodiment, the housing includes first and second separate housing sections, the first housing section containing the controller and the second housing section containing the motor drive and the high ratio gear box means.

In the preferred embodiment, the second housing section has an interior for containing oil and the oil surrounds the electric motor drive and the gear box.

In the preferred embodiment, there is provided a bulk head for separating the first and second housing sections and an electrical connector is positioned on the bulkhead for electrically communicating between the first and second housings so that electrical signals pass from the controller to the electric motor via the bulkhead and the electrical connector at the bulkhead.

In the preferred embodiment, there is further provided a cam which interfaces with a limit switch which switches current on and off to the motor and also gives ball position to the DTMF feedback circuit.

In the preferred embodiment, a hydrostatic compensator is provided for maintaining a selected, desired oil pressure level within the housing.

In the preferred embodiment, the controller includes a remotely operable system for changing the valve position from a location that is remote the undersea wellhead. The remotely operable system features a dual tone multi-frequency controller for activating the electric motor drive, using audible tones.

The present invention can thus be used to operate any desired type of valve and an undersea wellhead including for example, ball valves, shear seal valves, choke valves, and the like.

The preferred embodiment uses an umbilical cord that extends from the housing to a remote location.

Alternatively, the control system can be designed to operate in a completely electric mode with no assistance from hydraulics to shift the valves or blowout preventors. The hydraulic line, valves and related equipments are taken out of the control system.

In the completely electric operation, the electric motors and gear boxes are mounted directly on to the valve or blowout preventor. When functioned with a DTMF signal, the control system will supply power to the motor. The motor, through the gear box, will shift the valve to the desires position.

The completely electric operation is useful to control the position of "choke valves". Choke valves are mounted on wellheads to control the pressure at the wellhead and the rate of production. The control system is designed so that an operator can adjust the orifice on a choke valve to obtain the desired pressure and flow.

The control of choke valves would be achieved by mounting the electric motor and gear box directly on the choke valve. The operator, at a remote control station would send DTMF signals to the wellhead until the choke valve was in the desired position.

In the electric mode of operation, electronics would be installed in a water-tight housing for subsea operation. Electric motors and gear boxes would be mounted in a water-tight housing attached to the valve to be operated.

Electric umbilicals would connect the motors to the electronics housing. The electric umbilicals would transmit power to the motor and also send data from the valve back to the electronics housing. Limit switches at the valve generate data which tells the electronics what position the valve or blowout preventor is in. At the electronics housing the data is converted to a series of "DTMF Bursts" which is sent back to the remote control panel. The control panel interprets these "DTMF bursts" and indicates valve position by lighting the appropriate LED.

Electric operation of valves and blowout preventors is useful because it reduces capitol expenditure costs of the control system by eliminating the hydraulic system completely (reservoir, pump, hydraulic hose, umbilical valves, accumulators, etc.). Speed of operation is also increased.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
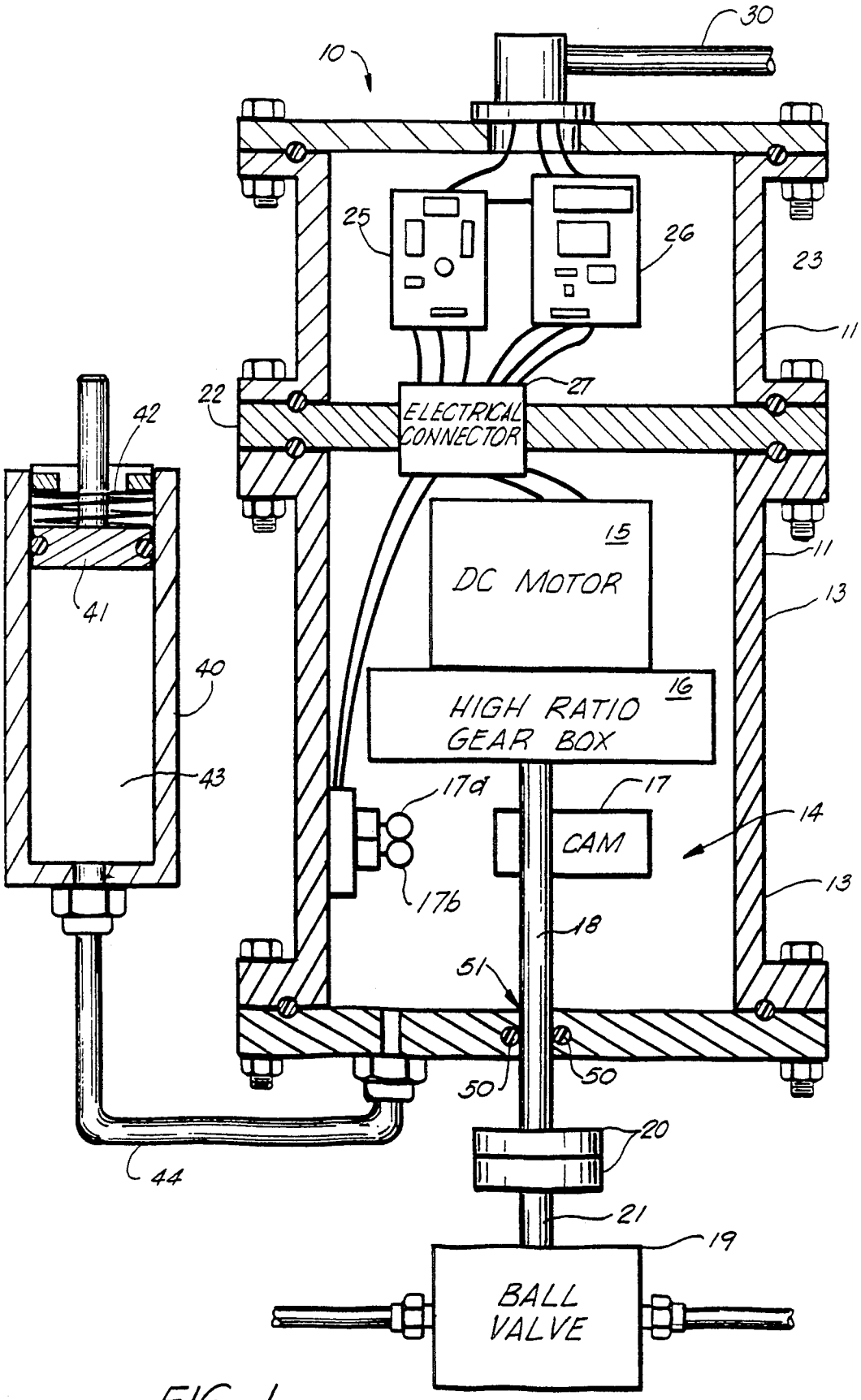
FIG. 1 is a elevational view of the preferred embodiment of the electro-hydraulic apparatus of the present invention illustrating the valve housing, motor drive, gear box and valve member.

FIG. 1 illustrates the preferred embodiment of the apparatus of the present invention designated generally by the number 10. Electro-hydraulic control system 10 for subsea wellheads includes a watertight housing 11 that includes an upper housing section 12 and a lower most housing section 13. The upper housing section 12 defines an electronics housing while the lower housing section 13 has a sealed interior 14 that defines motor and gear box housing that is filled during use with oil, preferably a silicone based oil.

Direct current motor 15 and high ratio gear train 16 are disposed within interior 14 and are interfaced so that activation of the DC motor 15 operates the high ratio gear box and rotates cam 17 to eventually operate limit switches 17 A, B that can define open flow and closed flow positions of the valving member. Output shaft 18 is then rotated through gear box 16 for moving the valving member of a valve (such as ball valve 19) between open flow and close flow positions. Shaft coupling 20 is positioned externally of housing 11 and couples drive shaft 18 to ball valve operator shaft 21. During use, the valve 19 is positioned adjacent housing 11 and is used for controlling fluid flow at a subsea wellhead with a movable internal valving member such as a ball member having a cylindrical opening therethrough. The valving member is movable into multiple flow control positions including at least an open flow position and a closed flow position. However, with the present invention, various incremental open flow positions can be achieved on a choke for example using an audible touch tone control (such as dual tone multi-frequency controlling) so that any desired incremental opening of the valve can be made.

Electric motor drive 15 is connected to high ratio gear box 16 so that the gear box interfaces motor drive 15 with valve 19. A dual tone multi-frequency (DTMF) controller, schematically illustrated as circuit board 25 is used to activate the electric motor drive from a remote location using the dual tone multi-frequency controlling. A bulkhead 22 extends transversely across housing 11 defining the separation between upper housing section 12 and lower housing section 13. A bulkhead electrical connector 27 is positioned at bulkhead 22 and communicates with the interior 14 of lower housing 13 and the interior 23 of upper housing 12. Umbilical 30 extends to an adjacent platform wherein an operator can send audible tones via the umbilical to circuit boards 25. In this manner, the DC motor can be activated to interface the high ratio gear box with the operating or output shaft 18 to thus open and close the ball valve 19.

Hydrostatic compensator 40 includes a spring 42 loaded follower piston 41 so that oil contained within the interior bore 43 of compensator 40 is under pressure and that pressure is transmitted to interior 14 of lower housing section 13 via conduit 44. Spring 42 tension can be adjusted to vary the amount of pressure that is placed on oil contained within interior 43 and thus the PSI of oil within interior 14 of lower housing 13. Pressure shaft seal 50 prevents leakage at the opening 51 in housing 11 where output shaft 18 penetrates the housing.

Figure 2:
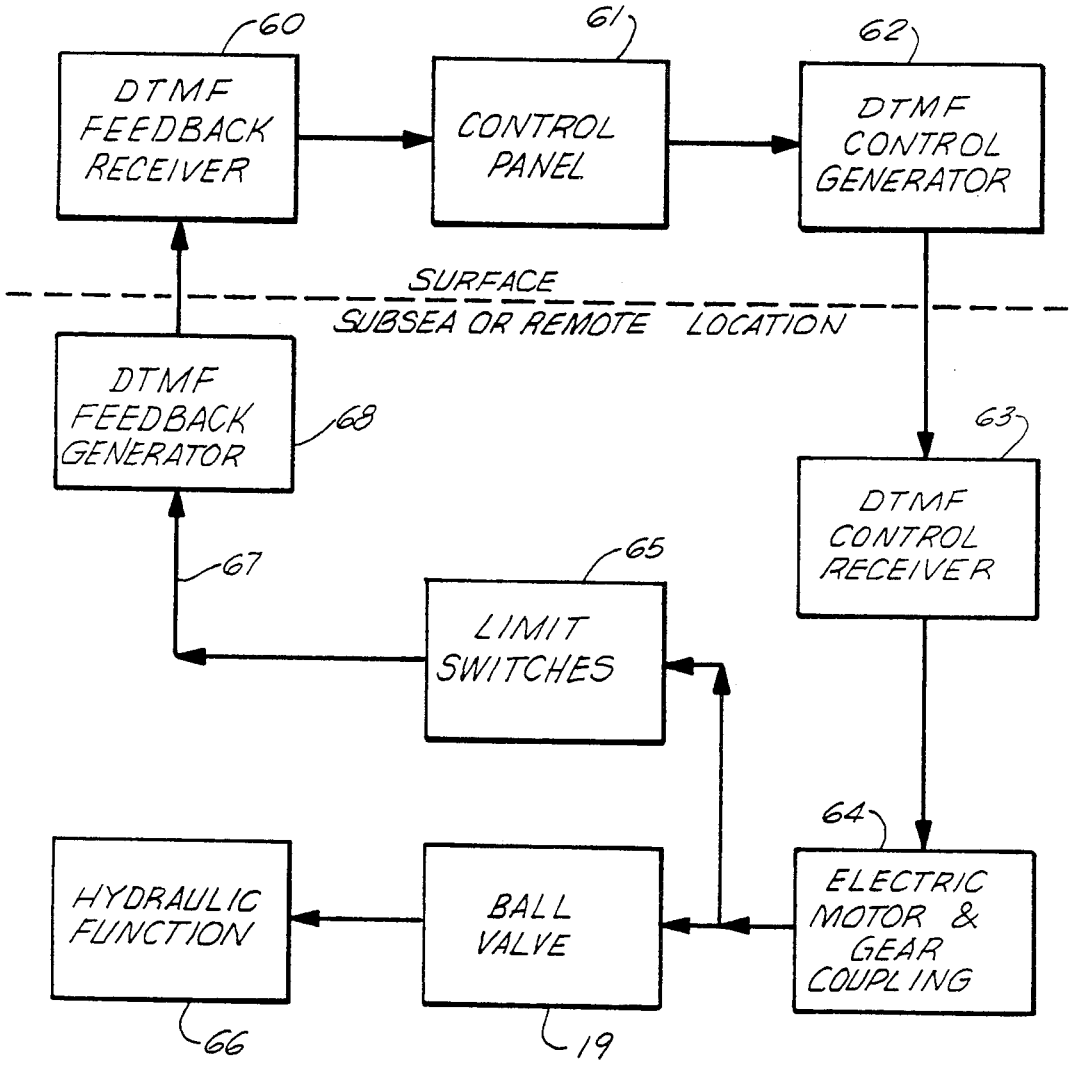
FIG. 2 is a schematic view of the preferred embodiment of the electro-hydraulic apparatus of the present invention illustrating the overall system.

In FIG. 2, a schematic view of the overall system of the present invention is shown wherein the dual tone multi-frequency feedback receiver 60 interfaces with a control panel 61. Dual tone multi-frequency control generator 62 is provided for sending audible signals to dual tone multi-frequency control receiver 63 which is at the subsea wellhead. In FIG. 2, electric motor 15 and high ratio gear box 16 are schematically illustrated at box 64, and wherein ball valve 19 is shown interfaced therewith. Limit switch 65 determines the position of the ball valve and thus gives valve position information to the dual tone multi-frequency feedback generator 68 via connection 67 so that accurate ball valve opening and closing positions are displayed at control panel 61.

Figure 3:
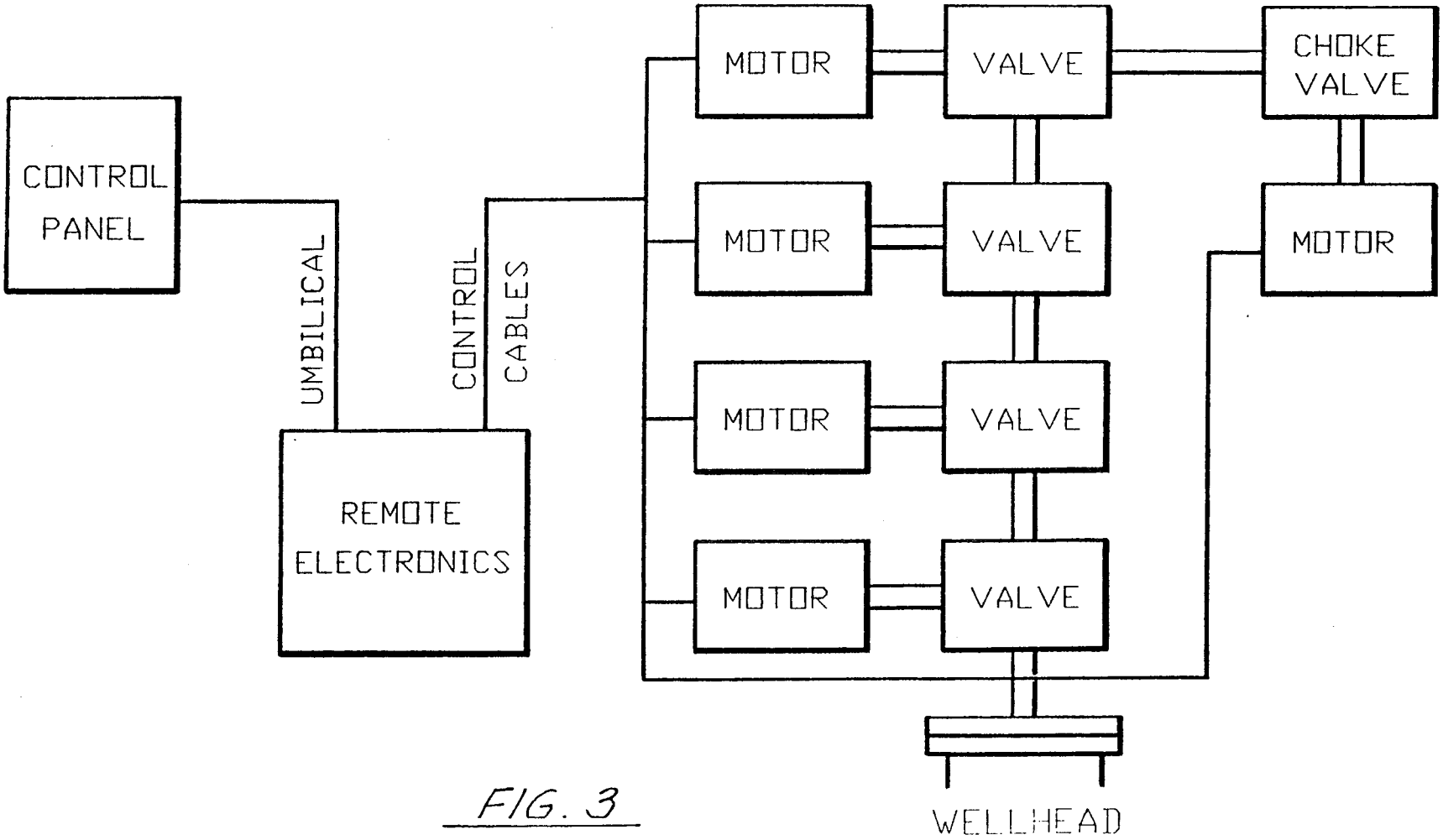
FIG. 3 is a schematic view of a second embodiment of the apparatus of the present invention, illustrating the control panel, umbilical, remote electronics housing, control cables, gear boxes, valves or blowout preventors and the well head.
Figure 4:
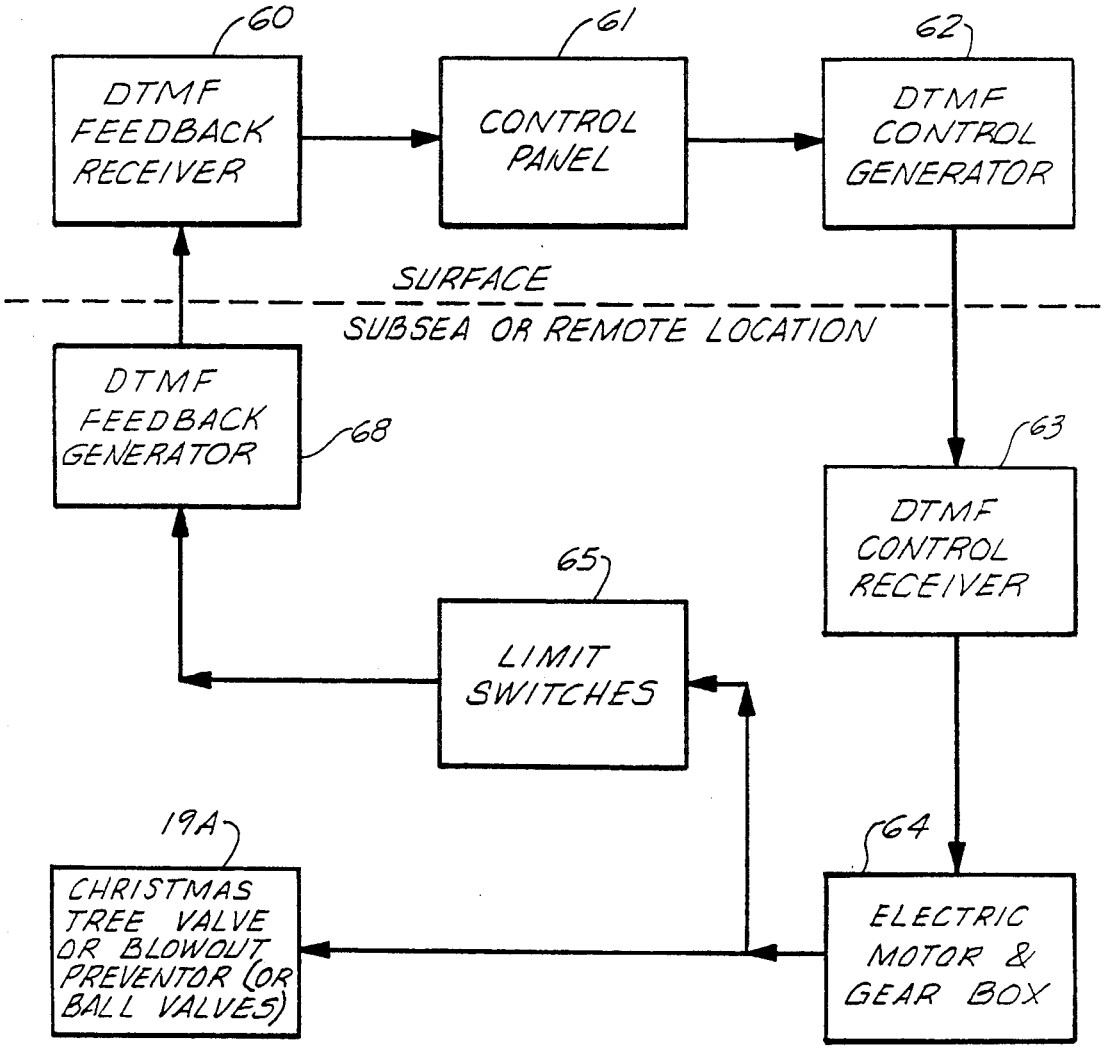
FIG. 4 is a schematic view of the preferred embodiment of the electric apparatus of the present invention illustrating the overall system.

FIG. 4 is a modification of the embodiment of FIG. 2 wherein an electric, rather than an electro-hydraulic system is disclosed. The hydraulic function of FIG. 2 has been eliminated as an electric motor and gear box 64 directly operates christmas tree valve, blowout preventor or ball valves, designated schematically as box 19A. In FIG. 3, an exemplary wellhead layout is shown using the electric operation of FIG. 3.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An electro-hydraulic control system for operating remote wellheads comprising:

a) a housing;

b) valve means positioned adjacent the housing for controlling fluid flow at a subsea wellhead with a movable valving member that moves into multiple flow control positions including at least an open flow position and a closed flow position;

c) an electric motor drive connected to the valve means for operating the valve means to maintain desired flow control positions of the valve;

d) controller means for activating the electric motor drive from a remote location, removed from the undersea wellhead;

e) controller means comprises in part remotely operable means for changing the valve position from a location that is remote from the undersea wellhead; and f) wherein the remotely operable means includes in part a dual tone multi-frequency controller for activating the electric motor drive.

2. The apparatus of claim 1 further comprising high ratio gear box means for interfacing the motor drive and valve.

3. The apparatus of claim 1 further comprising oil hydrostatic compensator means for maintaining a selected oil pressure level within the housing.

4. The apparatus of claim 1 wherein the housing comprises a pair of separate sections, and wherein one section contains the motor drive and the other section contains at least in part the controller means.

5. The apparatus of claim 1 wherein the housing includes first and second separate housing sections, the first housing section containing the controller means and the second housing section containing the motor drive and the high ratio gear box means.

6. The apparatus of claim 5 wherein the second housing section has an interior, for containing oil and the oil surrounds the electric motor drive and gear box.

7. The apparatus of claim 5 further comprising bulkhead means for separating the first and second housing sections and further comprising bulkhead electrical connector means for electrically communicating between the first and second housing sections.

8. The apparatus of claim 1 wherein the valve means is a ball valve.

9. The apparatus of claim 1 wherein the controller means comprises in part remotely operable means for changing the valve position from a location that is remote from the undersea wellhead.

10. The apparatus of claim 1 wherein the remotely operable means can incrementally change valve position to multiple positions that are in between full open flow and closed positions.

11. The apparatus of claim 1 wherein the valve means is a choke valve.

12. The apparatus of claim 10 wherein the valve means is a shear seal valve.

13. The apparatus of claim 1 wherein the controller means includes an umbilical cord that extends from the housing to a remote location.

14. The apparatus of claim 1 wherein the housing comprises an electrical motor housing portion that is filled with oil for housing the electric motor drive, and an electronics housing portion for containing the controller means, and further comprising an electrical umbilical cord that connects to the housing at the electronics housing portion.

15. The apparatus of claim 14 wherein the controller means includes means for generating audible tones at a remote location and interpreting means within the housing for activating the electric motor drive responsive to receipt of an audible tone.

16. The apparatus of claim 1, wherein the housing is at least partially filled with oil.

17. The apparatus of claim 1, wherein the valve means is a choke valve.

18. The apparatus of claim 9, wherein the valve means is a shear seal valve.

* * * * *